US005860830A

United States Patent [19]

Wu

[11] Patent Number: 5,860,830

[45] **Date of Patent: *Jan. 19, 1999**

[54] LAMP SOCKET STRUCTURE

[76] Inventor: Jeng-Shyong Wu, 4 Fl. No. 5 Hsing Shyue Road, Hsin-Chu City, Taiwan

[ * ] Notice: The term of this patent shall not extend beyond the expiration date of Pat. No. 5,766,024.

[21] Appl. No.: 582,694

[22] Filed: Jan. 4, 1996

Related U.S. Application Data

[63] Continuation of Ser. No. 156,315, Nov. 23, 1993, abandoned, which is a continuation-in-part of Ser. No. 84,516, Jun. 29, 1993, abandoned.

[51] Int. Cl.[6] ..... H01R 4/24

[52] U.S. Cl. ..... 439/419

[58] Field of Search ..... 439/419, 414, 439/659, 658, 404, 391

[56] References Cited

U.S. PATENT DOCUMENTS 2,657,367 10/1953 Brooks ..... 439/414 OR
3,372,362 3/1968 Schick ..... 439/419 OR
5,051,877 9/1991 Liao ..... 439/419 X
5,109,324 4/1992 Ahroni ..... 439/419 X

*Primary Examiner*—P. Austin Bradley
*Assistant Examiner*—Daniel Wittels
*Attorney, Agent, or Firm*—Buckman and Arch

[57] ABSTRACT

A lamp socket structure consisting of an insulated housing, a cover, at least one insulated conductor, a conductive screw shell and a plurality of piercing plates wherein the portion of the insulated conductor and the piercing plates are securely disposed between the insulated housing and the cover. The insulated housing has an opening at one end for receiving the screw shell which receives the base of a lamp and the cover secures title housing and screw shell by hooks or extended flanges. Each piercing plate has a sharp portion capable of penetrating the insulation of the insulated conductor to contact the wire therein and another end forming a contact terminal for connection to the screw shell or an electrode of the lamp base.

13 Claims, 11 Drawing Sheets

LAMP SOCKET STRUCTURE

This is a Continuation, of application Ser. No. 08/156,315, filed Nov. 23, 1993, now abandon which is a Continuation-In-Part of Ser. No. 08/084,516 filed Jun. 29, 1993, now abandon.

BACKGROUND OF THE INVENTION

The present invention relates to lamp sockets for the series or parallel connection of electric lamps in a light string, and particularly to those receiving miniature screw-in type lamps operating at a low voltage.

Small and miniature lights are commonly used in decorative light strings and on various natural and artificial elements. Each light is configured as a socket and a lamp. The socket receives a portion of the lamp base of the lamp and makes electrical contact between the filament of the lamp and the electrical power lines.

Normally, a lamp with a bayonet base is inserted into the socket and makes contact with the outside power lines. For example, in U.S. Pat. No. 4,807,098, a lamp bulb with two filament leads are inserted in a circular socket, then the socket is pushed in a housing with contact plates which are connected with the outside electrical power lines. Alternatively, the lamp base is screwed into the socket by a rotational thread. A particular problem encountered with the push-in type lamp is that it easily loses electrical contact during use, as a result of accidental touching or vibration thereof. The screw-in type lamp may be better for secured connection but it causes other problems, such as high cost, difficulty in bonding the socket and housing and soldering the wires to outside lines.

SUMMARY OF THE INVENTION

Accordingly, it is an object of the present invention to provide a positive connected socket for a screw-in type lamp.

Another object is to provide a socket for screw-in type lamp which is securely bonded and safely connected for electricity.

A further object is to provide such a socket in which no soldering is necessary to assemble the parts thus bringing production cost down to a reasonable level.

These and other objects, advantages and features are attained, in accordance with this invention by a lamp socket structure which comprises an insulated housing, a cover, at least one insulated conductor, a conductive screw shell and a plurality of piercing plates. The at least one insulated conductor is the cord which has one or more than one wires separated by insulation, the number of wires being based on the usage of series and/or parallel connection. A portion of said insulated conductor incorporated with said screw shell and said piercing plates are securely disposed between said insulated housing and said cover. Said insulated housing has an opening in one end to receive said screw shell and in turn said screw shell receives the lamp base of a lamp. Said cover is used to secure said housing and said shell by its hooks or extended flanges. Said piercing plate has a sharp portion capable of penetrating the insulation of said insulated conductor to make contact with the copper wires therein and another end of the piercing plate being a contact terminal which is connected to said screw shell or an electrode of the lamp base to achieve an electrical connection.

DETAILED DESCRIPTION OF THE PREFERRED EMBODIMENTS

Figure 1A:
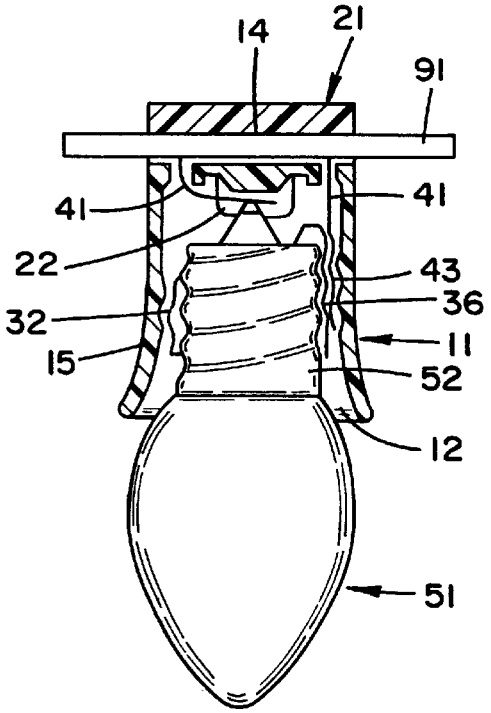
FIG. 1A is a cross sectional view of a socket structure according to an embodiment of the present invention and a lamp with a screw-in lamp base is inserted therein.

For explanatory purpose, the same reference numbers are used to indicate the same parts of components in the drawings.

Figure 1B:
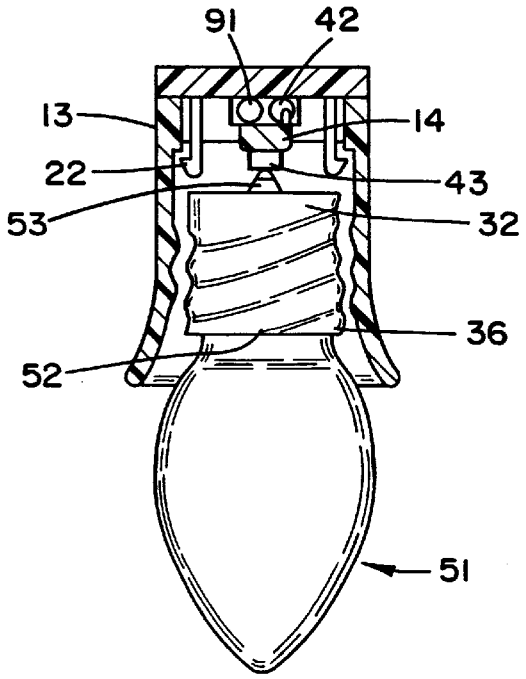
FIG. 1B is a side sectional view of a socket structure shown in FIG. 1A.

Referring now to the drawings and in particular to FIG. 1A and 1B in which is illustrated an assembly of the lamp socket structure with a lamp 51 inserted in the opening 12 thereof according to the present invention, wherein a conductible screw shell 36 which is made of copper or other suitable materials has been already inserted into the opening 12 of an insulated housing 11 of the socket. Two piercing plates 41 respectively pierce two insulated conductors 91 to achieve the electrical conduction from the outside power lines to the lamp 51. A cover 21 is placed and fixed on the end side 13 opposed to the opening 12 of the insulated housing 11 by a hook 22. In other words, two insulated conductors 91 and two piercing plates 41 are disposed on the end side of the insulated housing for connecting sharp ends 42 of said piercing plates 41 to said insulated conductors 91 respectively. Said cover is then placed on the end side of said insulated housing and fixed therein by hooks or extended flanges adapted to connect very tightly with extended flanges or recesses on the inside surface of said insulated housing. The other ends of said piercing plates 41 are contact terminals 43. One of these two ends is connected with the threaded peripheral portion 32 of said screw shell 36 which is connected with the side electrode of the lamp base 52 of the lamp 51. The contact terminal 43 of another piercing plate 41 being fixed on the central portion on the end side of the inner surface of the insulated housing 11. A hole is formed in the central portion at the end side of the screw shell 36 for connecting directly a central electrode 53 of the lamp base 52 to the contact terminal 43 on the central portion of the end side of the inner surface of the insulated housing 11. The material used and general form adapted are conventional in nature and well known to those skilled in the art; accordingly, further details thereof are not set forth herein.

Figure 2:
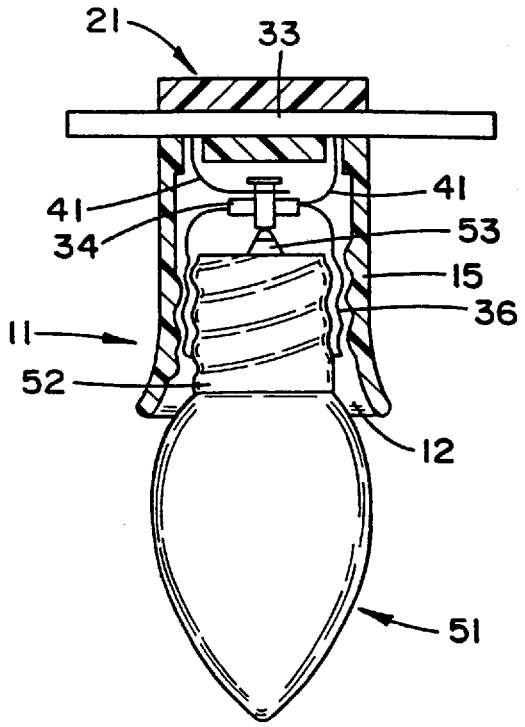
FIG. 2 is a cross sectional view of a socket structure according to yet another embodiment of the present invention and a lamp with a screw-in lamp base is inserted therein.

Another embodiment shown in FIG. 2 comprises also two insulated conductors 91 and two piercing plates 41 disposed in the insulated housing 11, the sharp ends 42 of the piercing plates 41 being connected to the insulated conductors 91 respectively by piercing through the insulation of the insulated conductors 91. The other ends of the piercing plates are contact terminals 43. One of the contact terminal 43 is connected with the threaded peripheral portion 32 of the screw shell 36 which is connected with the side electrode of the lamp base 52 of the lamp 51. The other contact terminal 43 of the other piercing plate 41 is connected with the central portion of the end side of said screw shell 36. An insulated element 34 is disposed between said two piercing plates 41 and connections thereon are in contact with the two electrodes of the lamp 51 respectively.

Figure 3A:
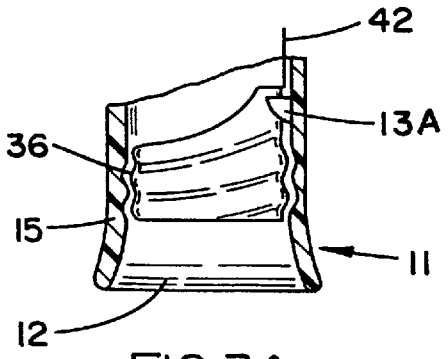
FIG. 3A is a schematic view of a portion of the socket shown in FIG. 2 showing the secured connection between the insulated housing and the screw shell.
Figure 3B:
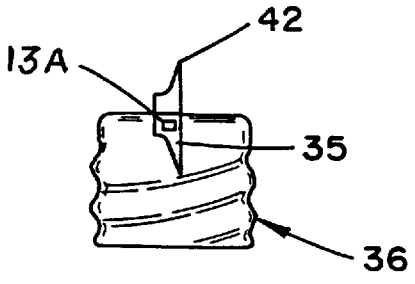
FIG. 3B is a schematic side sectional view of the portion of the socket shown in FIG. 3A.

As indicated in FIGS. 3A and 3B, yet another embodiment is set forth in the drawing to show particularly a portion of the socket, in which the connection between the insulated housing 11 and the screw shell 36 is secured. As their other respect components are similar to FIGS. 1A and 1B they are not again described herein. In FIG. 3A and its side view FIG. 3B, one of the piercing plates 41 is a part disposed directly on the screw shell 36 in such a way that a vertical piercing part 42 is integral with the screw shell 36 which is cut out or pressed by machine so as to pierce the insulation of an insulated conductor 91 to connect with the copper wire therein. A dent or a hole 35 is formed by pressing or cutting on the peripheral surface of the screw shell 36 for achieving a secured connection with recesses and juts 13A on the inside surface of the insulated housing 11.

Figure 4A:
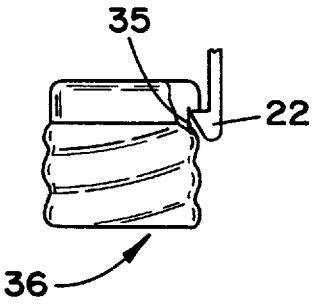
FIG. 4A is a schematic view of a portion of the socket shown in FIG. 2 showing the secured connection between the hook of the cover and the screw shell.
Figure 4B:
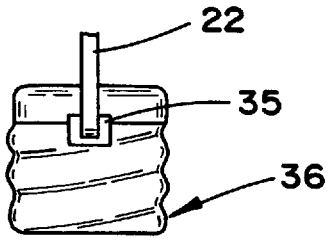
FIG. 4B is a schematic side sectional of the portion of the socket shown in FIG. 4A.

As shown in FIGS. 4A and 4B, according to another embodiment of the present invention an extended flange 22 on the cover 21 grips securely onto a dent or a hole 35 on the screw shell 36. By using this method, the assembly of inserting the screw shell 36 into the insulated housing 11 is made simple and time saving.

Figure 5:
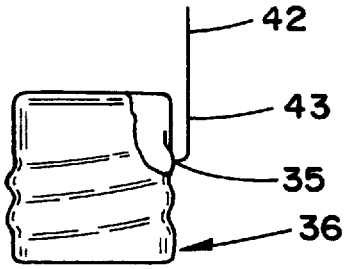
FIG. 5 is a schematic view of another type of hook used in FIG. 4A and FIG. 4B.

Now referring to FIG. 5, another embodiment is shown with the assembly as shown in FIGS. 4A and 4B. Therein is shown an end 43 of the piercing plate 41 fixed in a hole 35 of the screw shell 36. The tip of the end 43 is bent over the edge of the hole 35 to form a secured connection between the piercing plate 41 and the screw shell 36.

Figure 6:
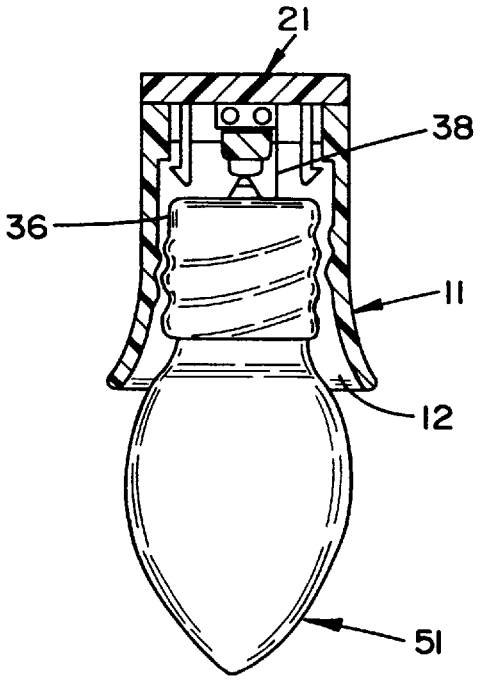
FIG. 6 is a cross sectional view of a socket structure with an extension portion on the screw shell according to yet another embodiment of the present invention and a lamp with a screw-in lamp base is inserted therein.

Referring to FIG. 6, yet another embodiment according to the present invention is shown with the assembly of the lamp socket structure with a lamp 51 inserted in the opening 12 of an insulated housing 11 as in FIG. 2 wherein the screw shell 36 includes an extension portion 38 disposed on the periphere of the base of the screw shell 36 and extending into the insulated housing 11 or the cover 21 to combine the screw shell 36 with the insulated housing 11 or the cover 21 securely. The free end of the extension portion 38 may be bent for securing a tight connection. Further, the other components are not changed.

Figure 7:
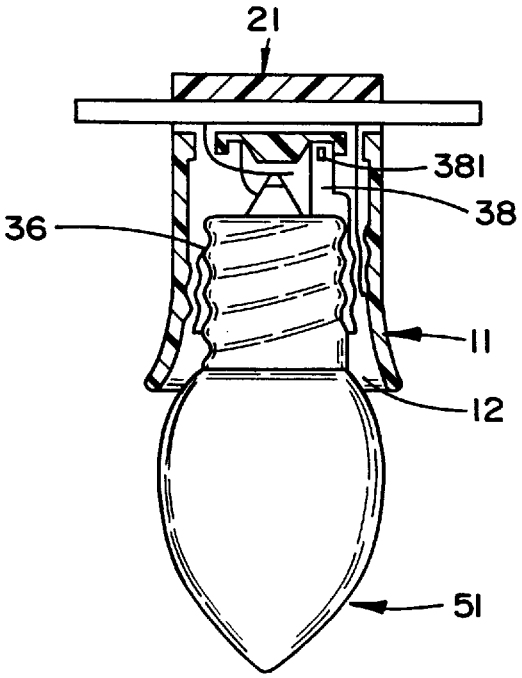
FIG. 7 is a cross sectional view of a socket structure with a holed extension portion disposed on the screw shell according to yet another embodiment of the present invention and a lamp with a screw-in lamp base is inserted therein.

Referring to FIG. 7 yet another embodiment according to the present invention is shown with the assembly of the lamp socket structure with a lamp 51 inserted in the opening 12 of an insulated housing 11 as in FIG. 6 except that the free end of the extension portion 38 disposed on the periphere of the base of the screw shell 36 has a hole or recess 381 in the tip thereof. The hole or recess 381 is used for inserting the jut (not shown) inside the insulated housing 11, or the extended flange 22 (not shown) inside the cover 21 for increasing combinative forces.

The insulated housing 11 of the present invention can be made of an inner end central portion and a outer shell separately (not shown), and the inner central portion is combined securely between the outer shell and the cover. The inner end central portion may also comprise holes, or recesses and juts (not shown) used for combining with the extension portion of the screw shell or piercing plate.

Figure 8A:
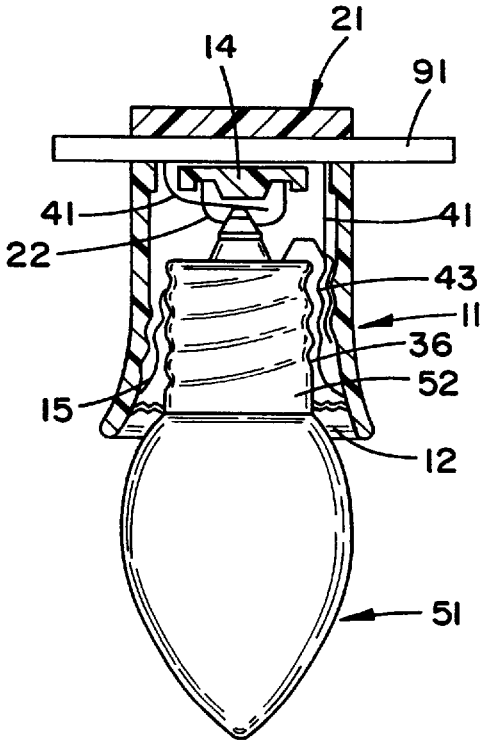
FIG. 8A is a cross sectional view of a socket structure with a screw-in lamp according to yet another embodiment of the present invention.
Figure 8B:
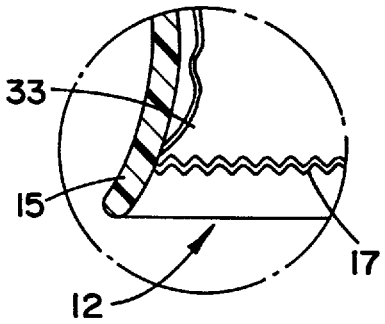
FIG. 8B is a schematic view of the portion of the socket shown in FIG. 8A showing the secured connection between the insulated housing and the screw shell.

Referring to FIG. 8, yet another embodiment according to the present invention is shown with the assembly of the lamp socket structure with a lamp 51 inserted in the opening 12 of an insulated housing 11 as in FIG. 1A, wherein said opening 12 of conductible screw shell 36 has a serrated edge 17 in the circumference 33 thereof. Said serrated edge 17 has an outer diameter slightly greater than the inner diameter of the inner surface 15 of said opening 12. When said conductible screw shell 36 is forced into said insulated housing 11, said serrated edge 17 is inserted into said inner surface 15 of said insulated housing 11 so that said screw shell 36 can be tightly fixed therein.

Figure 9:
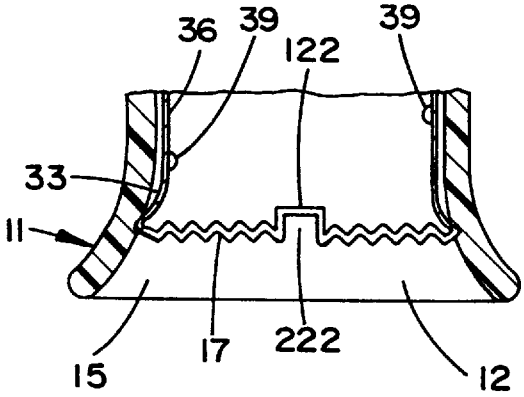
FIGS. 9 and 10 are schematic views of a portion of the socket according to yet another embodiment of the present invention.
Figure 10:
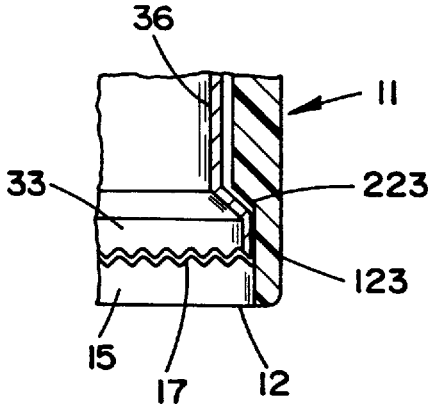

FIGS. 9 and 10 are partial views of the structure of yet another embodiment according to the present invention. It can be seen that said circumference 33 of said opening of said conductible screw shell 36 has a notch 122 or a jut 123 in the circumference 33 thereof, and the inner surface 15 of the insulated housing 11 has a jut 222 or a recess 223, said notch 122 engaging against said jut 222, or said jut 123 engaging against said recess 223 when said screw shell.36 is forced into said insulated housing 11 so that said screw shell 36 can be prevented from rotation and loosening.

Preferably the conductive screw shell 36 is provided with a plurality of pointed spots 39 disposed staggeringly on the inside surface thereof instead of the thread.

Figure 11A:
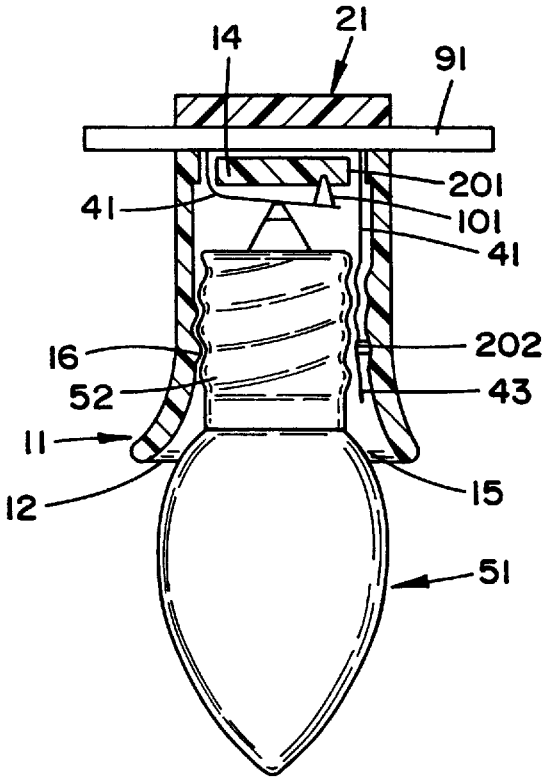
FIGS. 11A and 11B are sectional views of a socket structure according to yet another embodiment of the present invention in which a screw shell is partly or wholly not used.
Figure 11B:
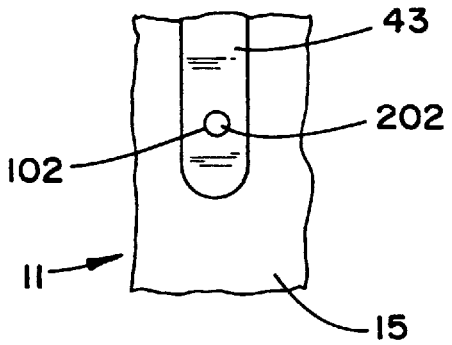

Referring to FIGS. 11A and 11B, yet another embodiment according to the present invention is shown with the screw shell 36 being partly or wholly replaced by a wave shaped thread on the inner surface 15 of said insulated housing 11. Preferably, said contact terminal 43 of the piercing plate 41 is provided with means for fixing the position so that the different electrodes of the piercing plates 41 are prevented from movement and contacting each other and producing a danger of short circuit. Alternatively, the contact terminal 43 of the piercing plate is made as an element having a shape of bending, flange, strut, hole, fork or hook which is connected with an element shaped as waviness, strut, hole or hook and so on in the inner surface 15 of the insulated housing 11 to fix the position of said screw shell 36, or has a hole 102 to be inserted with a strut 202 on the inner surface 15 of said insulated housing 11, or has a strut 101 inserting into a hole 201 in the inner surface 15 of the insulated housing 11 to fix the position.

Figure 12A:
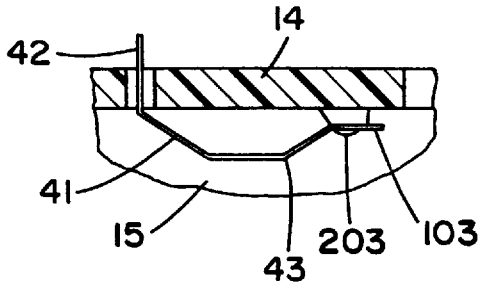
FIGS. 12A to 17B and 19A to 22B are part sectional view of modified connections between the contact terminal and the insulated housing.
Figure 12B:
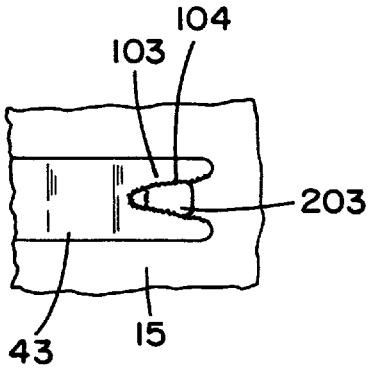
Figure 13:
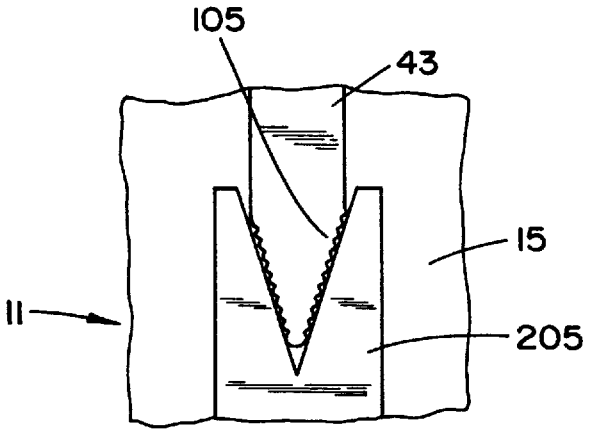

Referring to FIGS. 12A, 12B and 13, yet another embodiment is shown according to the present invention. A lamp socket structure as shown in FIG. 12A, in which the contact terminal 43 of the piercing plate 41 has a forked section 103, 205 connecting with a stub 203 or a terminal 43 has a serrated portion 105 engaging with a forked stub 205 on the insulated housing 11 to fix the position of the contact terminal 43.

Again referring to FIGS. 12A and 12B, the contact terminal 43 of the piercing plate 41 has a forked section 103 with saw-tooth flanges 104 inside to clamp into a stub 203 on the central portion 14 of the insulated housing 11 to increase the combination force.

Figure 14:
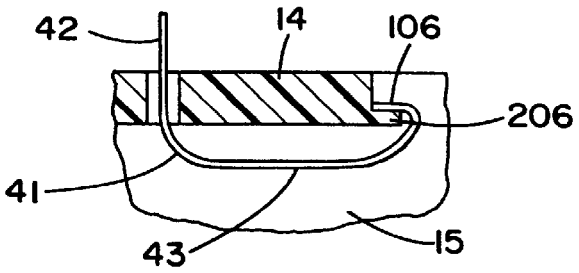
Figure 15:
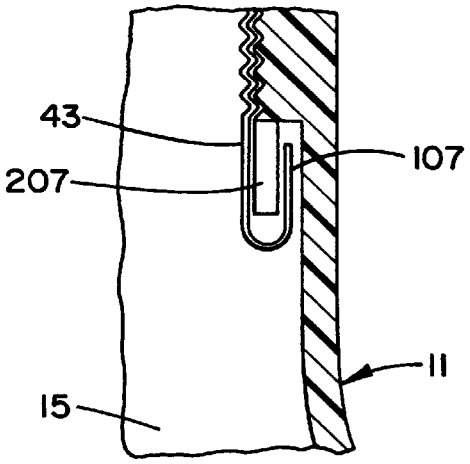
Figure 16A:
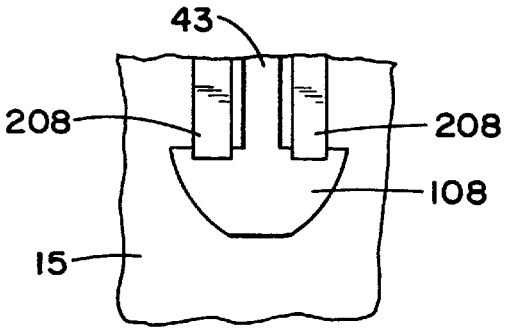
Figure 16B:
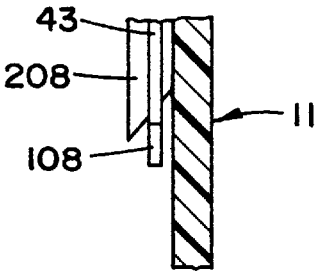

FIGS. 14, 15 and 16 are views of modified connections between a contact terminal 43 and a cover 14 or an inner surface 15 of the insulated housing 11, in which the contact terminal 43 of the piercing plate 41 has a hook 106, 107 which connects with the stub 206, 207 on the central portion 14 or on the inner surface of the insulated housing 11 to fix the position of the contact terminal 43 or has a stub connecting with a hook of said insulated housing to fix the position of said screw shell. The tip of the contact terminal 43 may be in a shape of a flange 108 which connects with hooks 208 securely on the inner surface of the insulated housing 11.

Figure 17A:
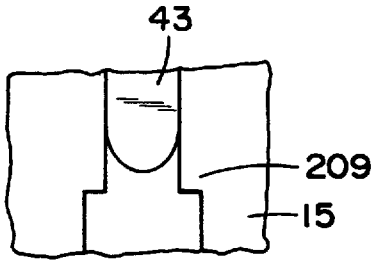
Figure 17B:
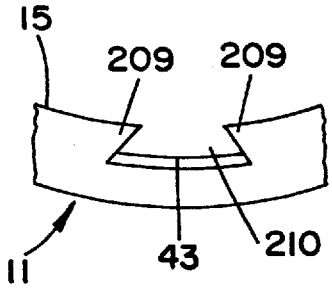
Figure 19A:
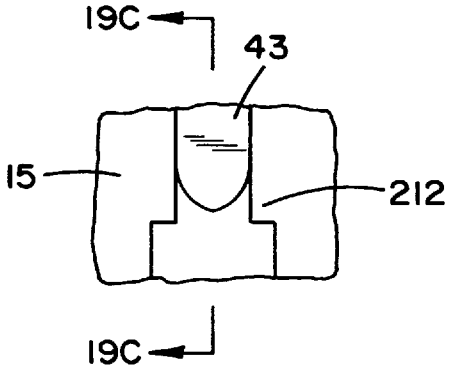
Figure 19C:
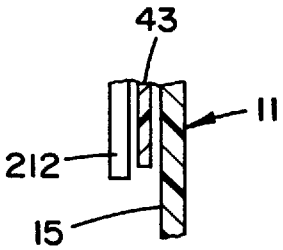
Figure 19B:
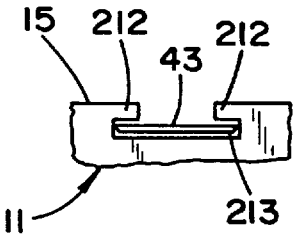
Figure 18A:
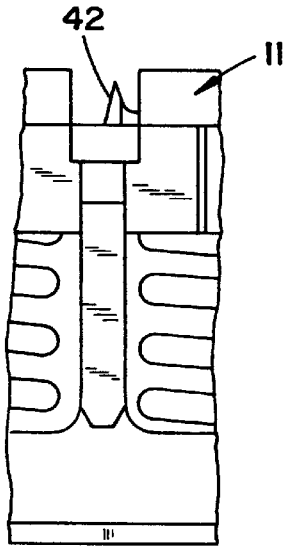
FIGS. 18A, 18B, 18C and 18D are a preferred embodiment of a socket structure of the present invention and a lamp with a screw-in lamp base is inserted therein.
Figure 18B:
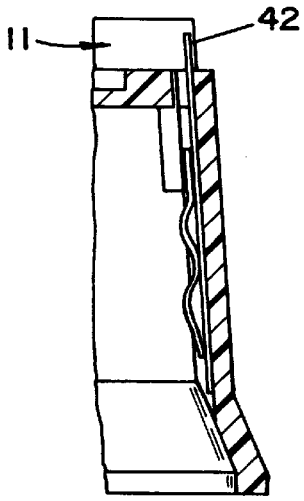
Figure 18C:
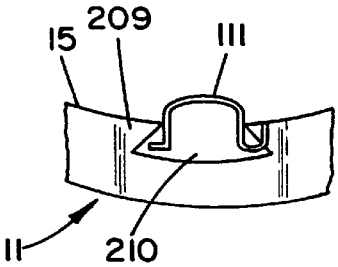
Figure 18D:
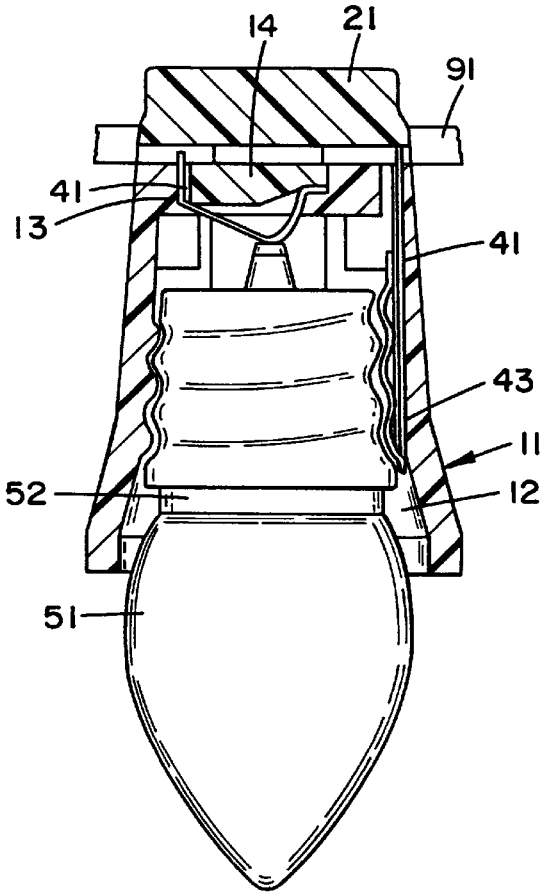
Figure 20A:
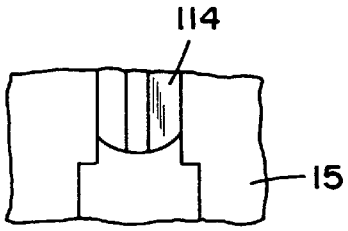
Figure 20C:
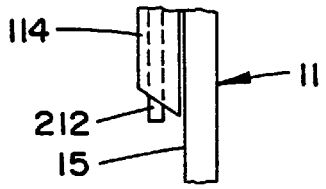
Figure 20B:
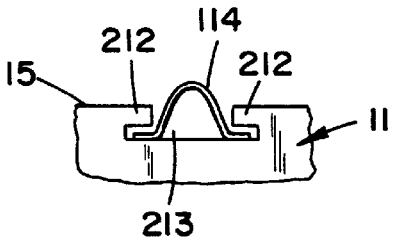
Figure 21:
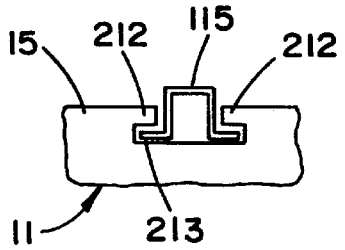

FIGS. 17A and 17B are views of other modified connections between a contact terminal 43 and an inner surface 15 of the insulated housing 11, in which said contact terminal 43 of piercing plate 41 is inserted into a blind hole 210 shaped as an inverted V in the inner surface 15 of the insulated housing 11 to fix the position thereof.

Referring now to FIGS. 18A, 18B and 18C and 18D, yet another embodiment according to the present invention is shown with the lamp socket structure with a lamp 51 inserted in opening 12 of an insulated housing 11 as in FIG. 1A, wherein two piercing plates 41 are respectively piercing into two insulated conductors 91 for achieving the electrical connection from the outside power lines to the lamp 51. A cover 21 is placed and fixed on the end side 13 opposed to the opening 12 of the insulated housing 11 by a hook 22. In other words, two insulated conductors 91 and two piercing plates 41 are disposed on the end side of the insulated housing for connecting sharp ends (not shown) of said piercing plates 41 to said insulated conductors 91 respectively. Said cover is then placed on the end side of said insulated housing and fixed therein by hooks or extended flanges capable to connect: very tightly with extended flanges or recesses on the inside surface of said insulated housing. The other ends of said piercing plates 41 are contact terminals 43. One of these two ends is connected with the threaded peripheral portion 32 of said screw shell 36 which is connected with the side electrode of the lamp base 52 of the lamp 51. The contact terminal 43 of another piercing plate 41 being fixed on the central portion on the end side of the inner surface of the insulated housing 11.

FIGS. 19A, 19B, 19C and 20 to 21 are views of other modified connections between a contact terminal 43 and an inner surface 15 of the insulated housing 11, in which said contact terminal 43 of piercing plate 41 has a shape of cap 114 or protruding block 115 inserted into a blind hole 213 shaped as an inverted T or an inverted V in the inner surface 15 of the insulated housing 11 to fix the position thereof.

Figure 22A:
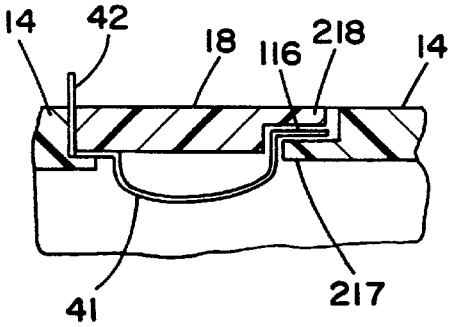
Figure 22B:
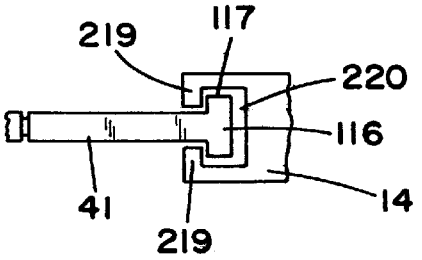

FIGS. 22A and 22B are views of other modified connections between a contact terminal 43 and a central portion 14 of the insulated housing 11, in which the contact terminal 116 of the piercing plate 41 is clamped between two flanges 217, 218 of the central portion 14 of the insulated housing 11 to fix the position thereof. The contact terminal 116 of the piercing plate 41 may have flanges 117 which are disposed into a channel 220 formed by one or two flanges or protruding blocks 219 on the central portion 14 of the insulated housing 11 to fix the position thereof. Preferably, a separate element 18 is disposed closely in the channel or hole 220 to press tightly on the contact terminal 116.

From the foregoing it will be appreciated that although specific embodiments of the invention have been described herein for purpose of illustration, various modifications and improvements thereon will become readily apparent to those skilled in the art. Accordingly, the appended claims are to be construed broadly and in a manner consistent with the spirit and scope of the invention described herein.

I claim:

1. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising an opening in at least one of the contact terminals of said pair of piercing plates engageable with a complimentary strut protruding from an inner surface of said insulated housing.

2. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising a strut protruding from at least one of the contact terminals of said pair of piercing plates engageable with a complimentary depression arranged on an inner surface of said insulated housing.

3. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising a forked section on at least one of the contact terminals of said pair of piercing plates adapted for connection with a stub protruding from an inner surface of said insulated housing.

4. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising a serrated section on at least one of the contact terminals of said pair of piercing plates engageable with a forked stub protruding from an inner surface of said insulated housing.

5. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising at least one of the contact terminals of said pair of piercing plates having a forked shape with a saw tooth serration therein adapted to clamp onto a stub protruding from an inner surface of said insulated housing.

6. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising at least one of the contact terminals of said pair of piercing plates having a hook adapted for engagement with a protruding stub on an inner surface of said insulated housing.

7. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising at least one of the contact terminals of said pair of piercing plates having a stub engageable by a hook arranged on an inner surface of said insulated housing.

8. A lamp socket structure for receiving an illumination element having a base, said structure comprising:

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising at least one of the contact terminals of said pair of piercing plates being cap shaped with outwardly extending flanges insertable in a groove in an inner surface of said insulated housing, said groove having walls engaging said outwardly extending flanges.

9. The lamp socket structure as defined in claim 8, wherein the groove in the inner surface of said insulated housing is an inverted T shape.

10. The lamp socket structure as defined in claim 8, wherein the groove in the inner surface of said insulated housing has an inverted V shape.

11. A lamp socket structure for receiving an illumination element having a base, said structure comprising;

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising at least one of the contact terminals of said pair of piercing plates being clamped between two flanges arranged on a central portion of said insulated housing.

12. A lamp socket structure for receiving an illumination element having a base, said structure comprising;

an insulated housing having an opening formed therein for receiving the base of said illumination element;

a cover arranged on said insulated housing opposite said opening securing a portion of a pair of insulated conductors between said cover and said insulated housing;

a pair of piercing plates each comprised of a unitary structure and each of which corresponds to one of said pair of insulated conductors and each having a sharp first end portion adapted to penetrate the insulation and contact a conductive wire of the secured portions of said pair of insulated conductors, said pair of piercing plates each having a second end portion forming a contact terminal, the contact terminal of a first one of said pair of piercing plates being adapted to contact a center electrode of said illumination element base and the contact terminal of a second one of said pair of piercing plates being adapted to contact a side electrode of said illumination element base; and means for fixing the position of each of said pair of piercing plates within said lamp socket structure so as to prevent movement of said piercing plates and contact therebetween, comprising a channel formed on a central portion of said insulated housing by two flanges and at least one of the contact terminals of said pair of piercing plates having a flange disposed in said channel.

13. The lamp socket structure as defined in claim 12, wherein said two flanges on said central portion of said insulated housing are comprised of two separate elements arranged adjacent to said channel and pressed tightly on said at least one contact terminal of said pair of piercing plates.

* * * * *